US005749441A

United States Patent [19]

Bittar et al.

[11] Patent Number: 5,749,441

[45] Date of Patent: May 12, 1998

[54] EXTRA DECK ELEVATOR SHUTTLE

[75] Inventors: Joseph Bittar, Avon; Paul Bennett, Waterbury; Gilbert W. Wierschke, West Simsbury; Samuel C. Wan, Simsbury; Bruce A. Powell, Canton; Frederick H. Barker, Bristol; Richard C. McCarthy, Simsbury; Anthony Cooney, Unionville, all of Conn.

[73] Assignee: Otis Elevator Company, Farmington, Conn.

[21] Appl. No.: 588,577

[22] Filed: Jan. 18, 1996

[51] Int. Cl.[6] ..... B66B 9/00

[52] U.S. Cl. ..... 187/249; 187/902; 187/382

[58] Field of Search ..... 187/249, 902, 187/382

[56] References Cited

U.S. PATENT DOCUMENTS 1,939,729 12/1933 Stark ..... 187/249

FOREIGN PATENT DOCUMENTS 403238275 10/1991 Japan ..... 187/902

OTHER PUBLICATIONS

Strackosch, G.R.; "Vertical Transportation: Elevators and Escalators", pp. 472–475, New York: 1983.

*Primary Examiner*—William E. Terrell
*Assistant Examiner*—Khoi H. Tran

[57] ABSTRACT

An elevator shuttle includes a plurality of elevator hoistways (14, 19, 24) which overlap, the elevator car frames (13, 21, 25) traveling in each hoistway including two decks per cab being carried by the car frame, plus an extra deck on car frames (20) in other than the highest (24) and lowest (14) hoistways. This allows cabs (C) traveling simultaneously, upwardly, in three or more hoistways to pass cabs (A, B) simultaneously traveling downwardly in those hoistways. The cabs may be loaded and unloaded while in the hoistway (FIGS. 1, 13, 21) or while in off-hoistway landing areas (FIG. 28). Embodiments include one cab per hoistway and two cabs per hoistway; three hoistways and four hoistways.

22 Claims, 12 Drawing Sheets

26 SKY
28
24
TOP 25
20 MID
21 3rd
19
CYC 1
16 2nd
14
27
15 GND
13 BOT

CYC 2

28
SKY LO
TOP 25
CYC 3
13 BOT
2nd LO

CYC 4

TOP 25
3rd HI
CYC 5
13 BOT
GND HI

CYC 6
27

TOP 25
SKY HI
CYC 7
13 BOT
2nd HI

28
CYC 8

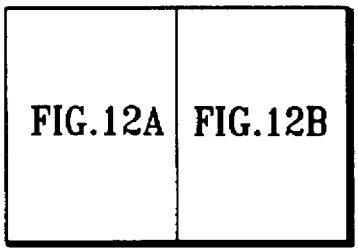
FIG.12
FIG.12A
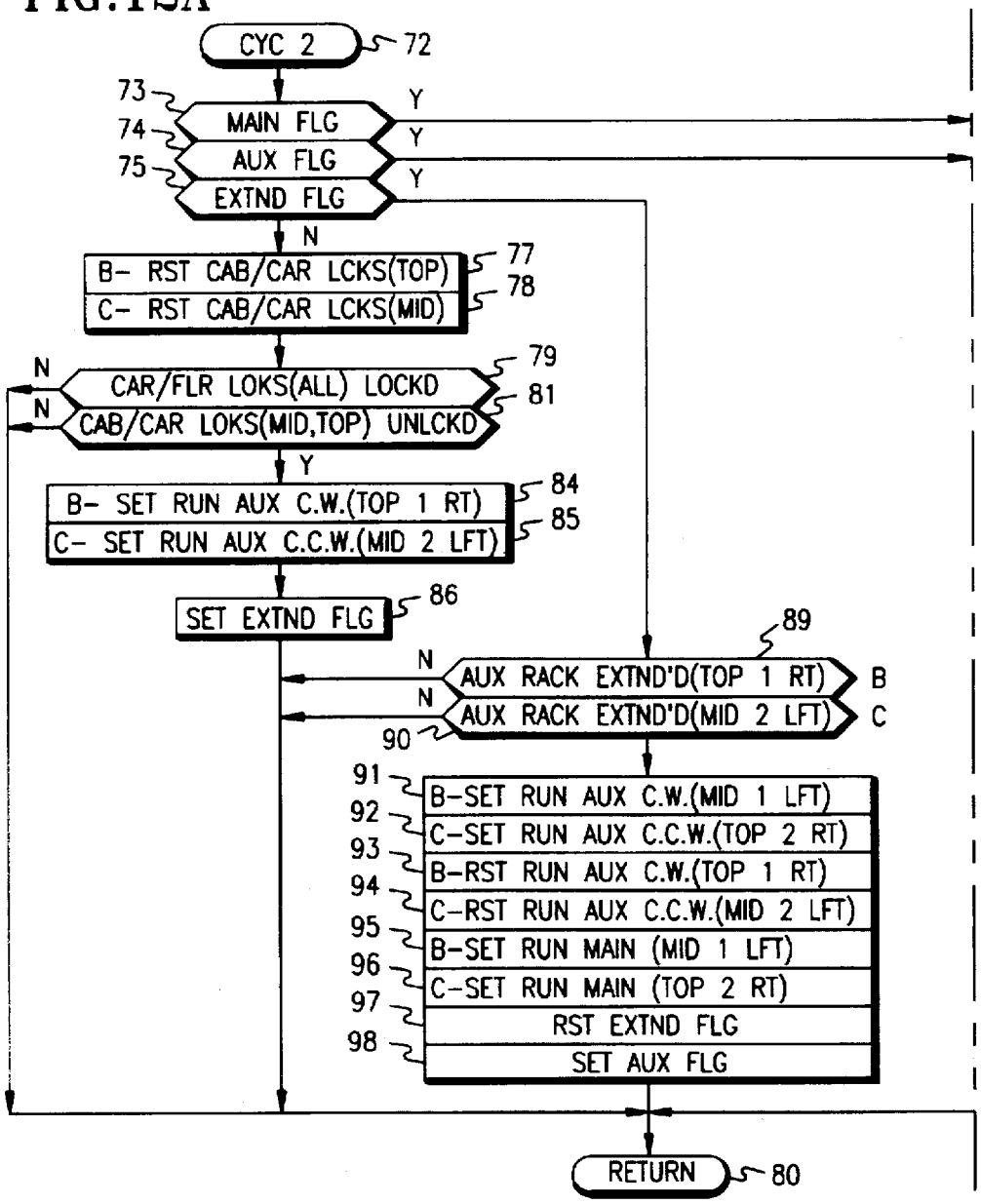

LO
HI
A
B
C
D

HI
LO
A
B
C

CYC 1
CYC 2
CYC 3
CYC 4
CYC 5
CYC 6
CYC 7
CYC 8
111 TOP
110 BOT

EXTRA DECK ELEVATOR SHUTTLE

TECHNICAL FIELD

This invention relates to transferring horizontally movable elevator cabs between upper decks and lower decks of elevator car frames, with an extra deck to allow up-traveling cabs to pass down-traveling cabs in a shuttle having three or more hoistways.

BACKGROUND ART

Since all of the passengers for upper floors of a building must travel upwardly through the lower floors of the building, very tall buildings require effective use of elevator hoistways (referred to herein as the "core" of the building). In a commonly owned U.S. patent application Ser. No. (Attorney Docket No. OT-2322), filed on Nov. 29, 1995, an elevator shuttle includes overlapping elevator hoistways, each having a double deck car frame therein. A cab traveling in one direction (up, down) is transferred from the lower deck of one elevator car frame to the lower deck of the other car frame, simultaneously with transferring a cab traveling in the opposite direction from the upper deck of the other car frame to the upper deck of the one car frame. However, while that provides for a cab moving in each hoistway at all times so long as there are only two overlapping hoistways, it is impossible to have cabs moving in three or more hoistways at one time in such a system. In a three-hoistway system of said application, either the uppermost or the lowermost one of three hoistways has an empty car frame waiting for a cab. In other words, only two of the three hoistways are carrying passengers at any given time.

DISCLOSURE OF INVENTION

Objects of the invention include improving the utilization of elevator hoistways in which a plurality of elevator cabs are transferred among a plurality of decks of car frames movable in overlapping hoistways.

According to the present invention, an elevator shuttle system having three or more overlapping hoistways employs elevator car frames having two decks per elevator cab that is movable in a given hoistway at any one time, all of the hoistways except the uppermost hoistway and the lowermost hoistway having an extra deck to facilitate transfer of cabs between all of the hoistways, without upwardly traveling cabs interfering with downwardly traveling cabs. According to the invention in one form, an elevator shuttle employing three hoistways utilizes double deck elevator car frames in the uppermost and lowermost hoistways, and a triple deck elevator car frame in the intermediate hoistway, there being a cab traveling in each of the hoistways simultaneously. In accordance with the invention in another form having four overlapping hoistways, four-deck elevator car frames are used in the uppermost and lowermost hoistway, and five-deck elevator car frames in the two intermediate hoistways. The invention is extendible to any number of overlapping hoistways, provided that the intermediate hoistways have one extra deck in addition to the two decks per cab required in all of the hoistways.

The invention may be used in embodiments where passengers enter onto and exit from the elevator cabs while they are disposed in the hoistway, in a usual fashion, or it may be utilized in embodiments in which cabs are transferred to landings for off-hoistway loading and unloading of passengers.

The present invention increases the number of passengers movable in a given shuttle by almost the same multiple as the number of hoistways; in other words, a three-hoistway system in accordance with the invention will carry nearly three times as many passengers as a single hoistway shuttle; a four-hoistway system will carry nearly four times as many passengers as a single hoistway shuttle, and so forth.

Other objects, features and advantages of the present invention will become more apparent in the light of the following detailed description of exemplary embodiments thereof, as illustrated in the accompanying drawing.

BEST MODE FOR CARRYING OUT THE INVENTION

Figures 1, 2, 3, 4, 5, 6, 7, 8:
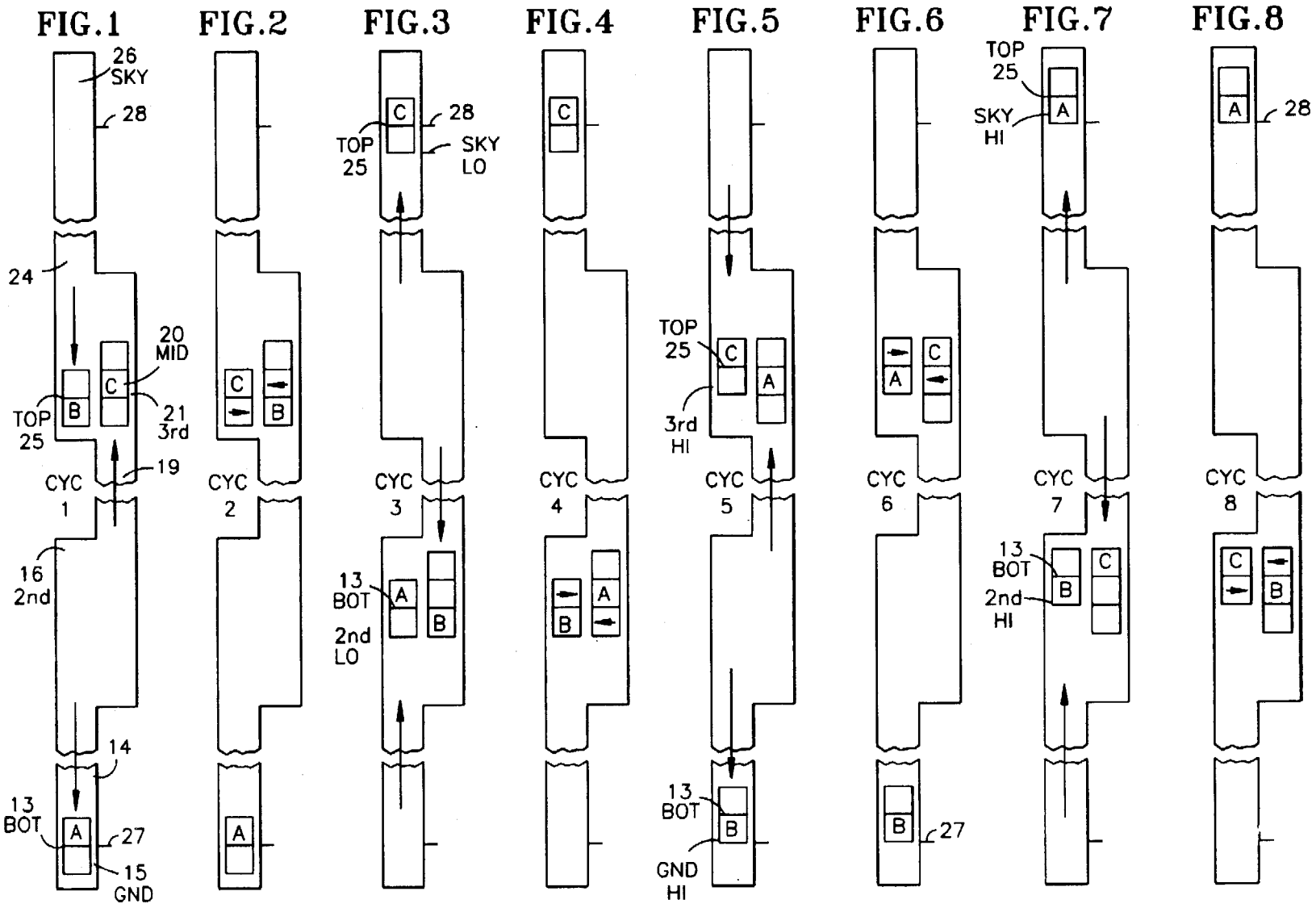
FIGS. 1–8 are simplified, stylized, side elevation views of eight successive cycles of operation of a three-hoistway, extra deck elevator shuttle according to the invention.

Referring to FIG. 1, a bottom elevator car 13 (BOT) is movable in a hoistway between a ground level 15 (GND) and a second level 16 (2nd) of a building. The hoistway 14 overlaps with a hoistway 19 within which a middle elevator 20 (MID) moves between the second level 16 and a third level (3rd) 21. The hoistway 19 overlaps with a hoistway 24 within which a top elevator 25 (TOP) moves between the third level 21 and a sky level 26 (SKY). The bottom and top elevators 13, 25 each comprise an elevator frame having two decks, each deck capable of carrying a cab, such as a passenger cab (A, B, C). The mid elevator 20 comprises a frame having three decks, each of which can carry a cab.

In this embodiment, the mid level elevator traverses between a given target floor at the third level and a given target floor at the second level, repetitively. On the other hand, the bottom elevator and top elevator can travel between a low position or a high position of the terminal levels of the corresponding hoistway. For instance, the bottom elevator may have as its target floor a ground low floor (GND LO) as shown in FIG. 1, or a ground high floor (GND HI) as shown in FIGS. 5 and 6. The bottom elevator may travel to a second level low floor (2nd LO) as seen in FIGS. 3 and 4 or a second high floor (2nd HI) as seen in FIGS. 7 and 8. Similarly, the top elevator may travel to a third level low floor as seen in FIGS. 1 and 2 or a third level high floor as seen in FIGS. 5 and 6 and a sky level low floor as seen in FIGS. 3 and 4 or a sky level high floor as seen in FIGS. 7 and 8. It is this capability of the bottom and top elevators that allow the passenger cabs to be aligned with the landings 27, 28 at the ground and sky levels, respectively, and which permit aligning with the mid elevator so as to be able to pass a cab from either its lower or upper deck to the mid elevator while receiving a cab from the center deck of the middle elevator at the same time. This is the principal characteristic of the invention, that allows upwardly and downwardly traveling cabs to pass without colliding, in a system having three or more hoistways in which cabs are moving in all hoistways at the same time. On the other hand, of course, the middle car could transfer between either upper or lower floors at the second and third level and the bottom floor could always transfer to the same floor of the second level together with the top floor always traveling to the same floor of the third level.

FIG. 1 depicts an interval during which each of the elevator car frames travel the length of the corresponding hoistway. When each car frame reaches the corresponding target floor, the run command for that elevator will cease, in the usual fashion. The next interval of operation is the transfer interval depicted in FIGS. 2, 4, 6 and 8 in which cabs are transferred between the middle elevator and either the top elevator or the bottom elevator.

Figure 9:
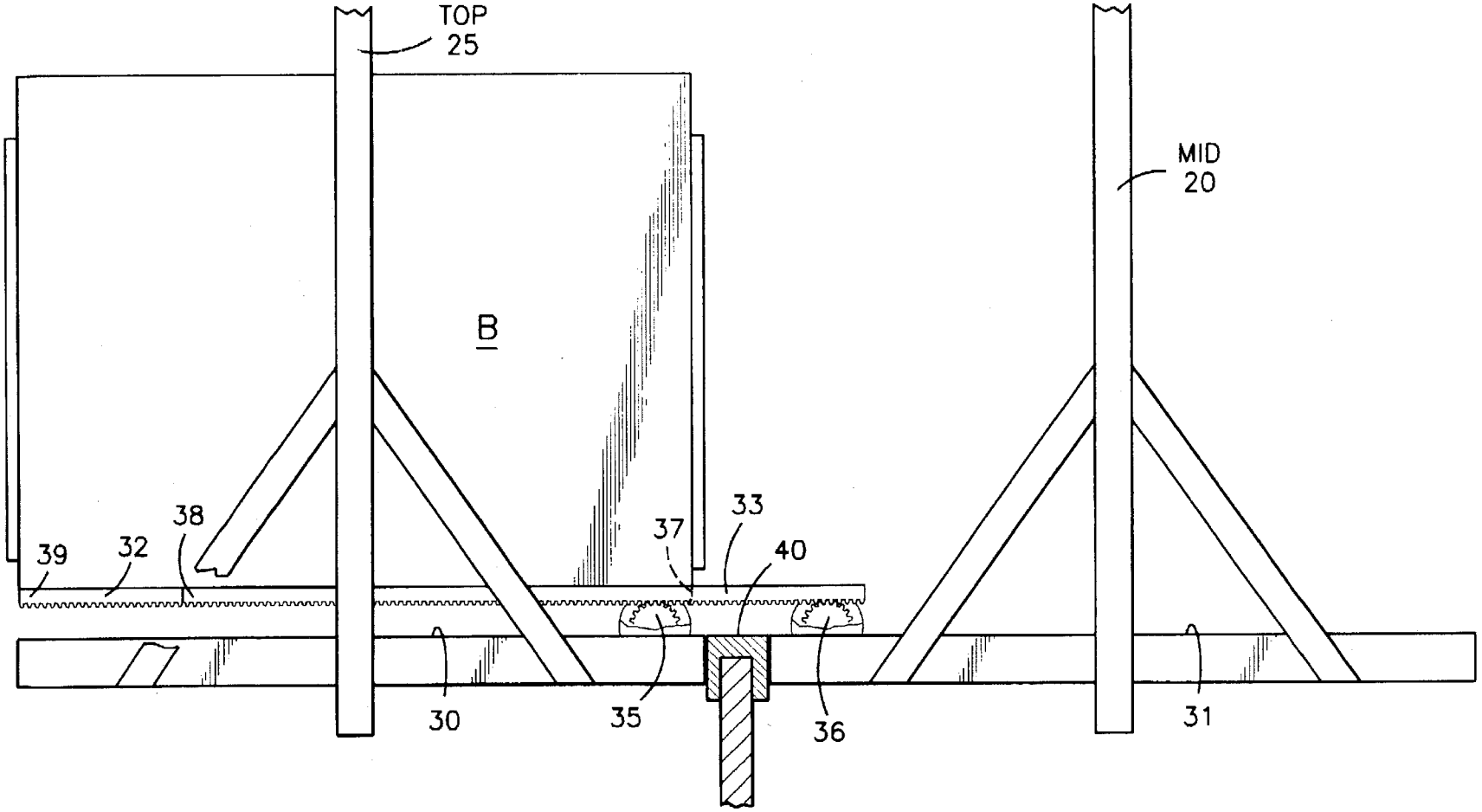
FIG. 9 is a simplified side elevation view of car frames and a cab, illustrating a horizontal motive means which the invention may use to move cabs from one car frame to another.

The means for transferring the cabs between the car frames may be the rack and pinion horizontal motive means disclosed in commonly owned U.S. patent application Ser. No. (Attorney Docket No. OT-2320), filed on Nov. 29, 1995. Such apparatus is partially shown in FIG. 9 in which the cab B (of FIGS. 1–8) is shown disposed on the lower deck 30 of the top elevator frame 25 as it is about to be transferred to the lower deck 31 of the middle car frame 20. The bottom of the cab B has a fixed, main rack 32 extending between the front of the cab and the back of the cab (right to left in FIG. 9), and a sliding rack 33 that can slide outwardly to the right, as shown, or to the left. There are two motorized pinions on each of the car frame platforms 30, 31. First, an auxiliary motorized pinion 35 turns clockwise to drive the sliding auxiliary rack 33 out from under the cab B into the position shown, where it can engage an auxiliary motorized pinion 36 on the platform 31, which is the limit that the rack 33 can slide. Then, the auxiliary motorized pinion 36 will turn clockwise pulling the auxiliary rack 33 (which is now extended to its limit) and therefore the entire cab B to the right as seen in FIG. 9 (on rollers or wheels not shown) until such time as an end 37 of the main rack 32 engages a main motorized pinion (not shown) which is located just behind the auxiliary motorized pinion 36 in FIG. 9. Then, that main motorized pinion will pull the entire cab B fully onto the platform 31 by means of the main rack 32, and as it does so, a spring (not shown) causes the slidable auxiliary rack 33 to retract under the cab B.

To return the cab B from the platform 31 to the platform 30, the auxiliary pinion 36 will operate counterclockwise, causing the sliding auxiliary rack 33 to move outwardly to the left until its left end 38 engages the auxiliary pinion 35. Then the auxiliary pinion 35 rotates counterclockwise to pull the auxiliary rack 33 and the entire cab B to the left until the left end 39 of the main rack 32 engages a main motorized pinion (not shown) located behind the auxiliary motorized pinion 35, which then pulls the entire cab B to the left until it is fully on the frame 30.

The top frame 25 has an additional platform (not shown) above the platform 30, and the mid platform 20 has two additional platforms (not shown) above the platform 31. In the description which follows, the auxiliary pinion 35 is referred to as "AUX (TOP LOWR RT)" and the main auxiliary pinion behind it is referred to as "MAIN (TOP LOWR RT)". The auxiliary pinion 36 is referred to hereinafter as "AUX (MID LOWR LFT)", and the main pinion behind it is referred to hereinafter as "MAIN (MID LOWR LFT)". At each position in each hoistway where a cab may be transferred from one car frame to another, there is a sill, such as the sill 40 extending between the two hoistways, over which the cab may travel, and to which the car frames may be locked, by car/floor locks (not shown) such as those disclosed in a commonly owned copending U.S. patent application Ser. No. (Attorney Docket No. OT-2286), filed on Nov. 29, 1995. Each cab, such as the cab B, can be locked to any platform, such as the platform 30, by means of cab/car locks (not shown) such as those disclosed in a commonly owned U.S. patent application Ser. No. (Attorney Docket No. OT-2284), filed on Nov. 29, 1995.

FIGS. 1–8 show all of the various conditions of a shuttle operating in accordance with this invention, in which three cabs move simultaneously in three hoistways. In FIG. 1, referred to as cycle 1, the top and bottom cabs have reached their extreme lowest position in their respective hoistways, and the middle cab has reached the upper position in its hoistway. Then, in FIG. 2, referred to as cycle 2, the top and middle car frames exchange cabs B and C, while cab A unloads and reloads passengers at the ground landing 27. In cycle 3, the top and bottom car frames go to the second highest position in their respective hoistways, referred to as 2nd LO for the bottom car frame 13, and referred to as SKY LO for the top car frame 25. Then in cycle four, shown in FIG. 4, the middle and bottom car frames exchange cabs A and B and passengers exit and enter cab C in the top car frame. In cycle five (FIG. 5), both the bottom and top car frames go to the second lowest positions in their respective hoistways, referred to as ground high (GND HI) for the bottom car frame 13 and third high (3rd HI) for the top car frame 25. In cycle six (FIG. 6) the middle and top cars exchange cabs A and C, and passengers unload from and then load into cab B at the ground landing 27. In cycle seven (FIG. 7) both the bottom and top car frames go to the highest floor position in their respective hoistways, referred to as second high (2nd HI) for the bottom car frame 13 and SKY HI for the top car frame 25. In cycle eight (FIG. 8), passengers in cab A are unloaded and loaded at the sky landing 28 and cabs B and C are exchanged by the middle and bottom car frames. It is assumed that the normal door opening and door closing sequences, utilized in conventional elevators, are utilized in the cabs while they are at landings in this embodiment.

Figure 10:
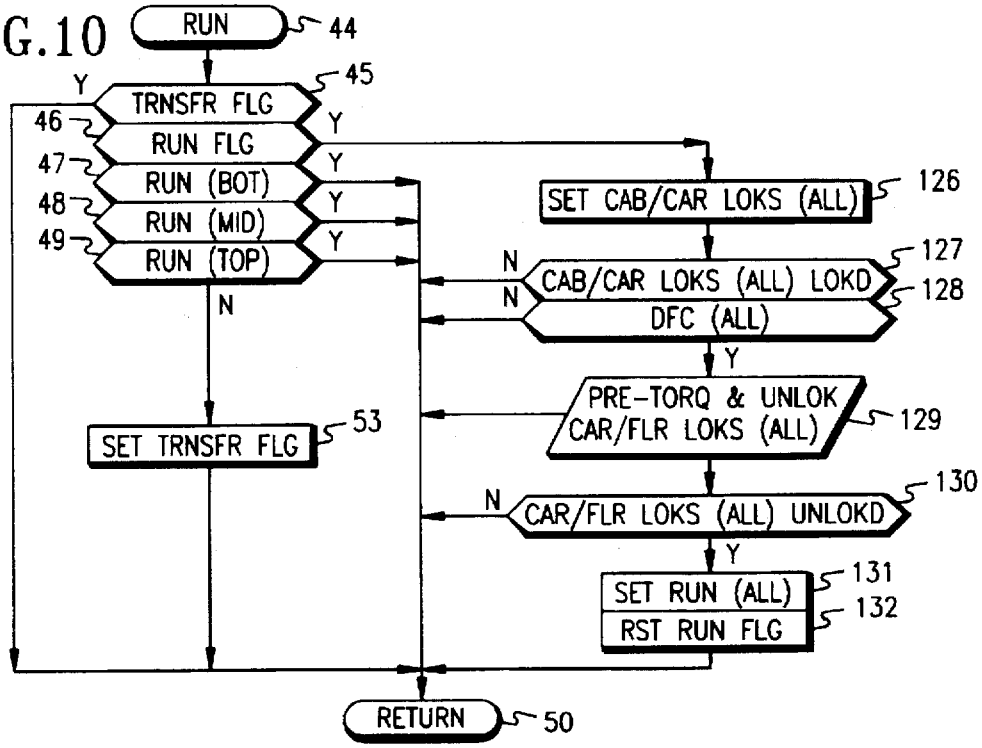
FIG. 10 is a logic flow diagram of a "run" routine for use in a controller employed with the present invention.

In the description that follows, the odd number cycles are considered "run" cycles and the even number cycles are considered "transfer" cycles. At the end of cycle one, the conditions for transferring cabs in cycle two and the direction of travel of the car frames in cycle three are established. In FIG. 10, as all three car frames are traveling in their hoistways (FIG. 1), the run routine is reached many times through an entry point 44. A first test 45 determines if a transfer flag, identifying setting up for the even number cycles, has been set as yet or not. Initially it will not have so a negative result of test 45 reaches a test 46 to see if a run flag, indicating the start of an odd cycle, has been set or not. Initially it will not have been set, so a negative result of test 46 reaches three tests 47–49 to see if any of the three elevators are still running. If any of the elevators (bottom, middle or top) is still running, then an affirmative result of the related test will cause other programming in the controller to be reverted to through a return point 50. When all three car frames have come to rest, negative results of all three tests 47–49 will reach a step 53 to set the transfer flag so that conditions for the following two cycles can be established. Once the transfer flag is set, other programming is reached through the return point 50. In subsequent passes through the run routine of FIG. 10, test 45 is affirmative therefore bypassing the rest of the routine of FIG. 10.

Figure 11:
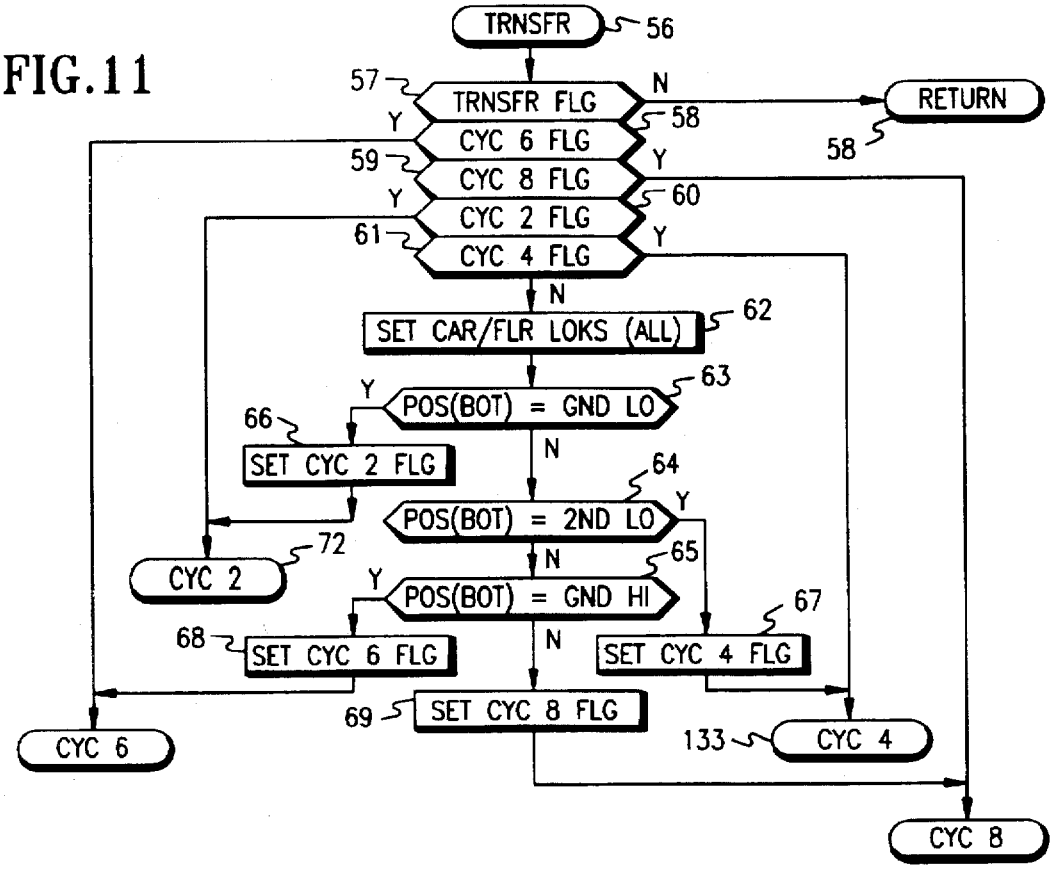
FIG. 11 is a logic flow diagram of a "transfer" routine for use in a controller employed with the present invention.

A transfer routine illustrated in FIG. 11 is periodically reached by the controller through a transfer point 56. Whenever the elevators are running, the transfer flag is not set so a first test 57 is negative causing other programming to be reached through a return point 58. However, once all three car frames have come to rest and the transfer flag is set, an affirmative result of test 57 reach a series of tests 58–61 to see if a corresponding cycle flag has been set, or not. Initially, in the first pass after the transfer flag is set, none of the cycle flags are set so a negative result of all four tests 58–61 will reach a step 62 to set the car floor locks for all three car frames, as described hereinbefore. Then a test 63 determines if the position of the bottom car frame is the ground low position (FIGS. 1 and 2). If it is not, a test 64 determines if the position of the bottom car frame is the second low position (FIGS. 3 and 4). If not, a test 65 determines if the position of the bottom car frame is the ground high position (FIGS. 5 and 6). If not, the position of the bottom car must be the 2nd HI position (FIGS. 7 and 8). An affirmative result of one of the tests 63–65 will cause a corresponding cycle flag to be set in a related step 66–68. If all three tests are negative, then a step 69 will set the cycle eight flag. Beginning with FIG. 1, when the cars come to rest, test 63 will be affirmative reaching step 66 setting the cycle two flag so that programming will advance through a transfer point 72 to a cycle two subroutine illustrated in FIG. 12. In each subsequent pass through the transfer routine of FIG. 11, test 57 will be affirmative, test 58 will be negative, test 59 will be negative, test 60 will be affirmative reaching the transfer point 72.

In FIG. 12, the cycle two subroutine has a first test 73 to see if a main flag (identifying when the main motorized pinions are moving a cab from one car frame to another) has been set or not. In a first pass through FIG. 12, it will not have, so a second test 74 determines if an auxiliary flag (indicating that the auxiliary pinion on the receiving platform is running) has been set or not. Initially it will not, so a test 75 is reached to determine if an extend flag has been set, indicating that the auxiliary rack is being extended as shown in FIG. 9. Initially it will not be set, so that a step 77 relating to cab B is reached, to reset the cab/car locks of the top car frame, and then a step 78, relating to cab C, will reset the cab/car locks for the middle car frame. This prepares the cabs so that they can be transferred from one car frame to the other. Then a test 79 determines if all of the car/floor locks have been locked, as is indicated by position detectors such as switches, referred to in the aforementioned application Ser. No. (Attorney Docket No. OT-2286). If the car frames are not locked, a negative result of test 79 will reach other programming in the controller through a return point 80. But if the locks are locked, then a test 81 determines if all the cab car locks of the middle and top car frames have become unlocked, as is indicated by position detectors such as switches, in a fashion described in the aforementioned copending application Ser. No. (Attorney Docket No. OT-2284). When both tests 79 and 81 are affirmative, the cabs are ready to be transferred. Affirmative results reach a step 84 relating to cab B which sets a run auxiliary counterclockwise signal for the auxiliary pinion located on the top car frame first deck at the right. This is the auxiliary pinion 35 referred to in FIG. 9. Then a step 85 relating to cab C sets a run auxiliary counterclockwise signal for the auxiliary pinion on the middle car frame, second deck on the left. And then a step 86 sets the extend flag to alter operation in future passes through the routine of FIG. 12, and other programming is reverted to through the return point 80.

In the next pass through the routine of FIG. 12, tests 73 and 74 will be negative, and test 75 will be affirmative reaching a pair of tests 89, 90 to see if the auxiliary rack on the first deck of the top car frame has been extended to the right (as indicated by a switch thereon), in the initial phase of moving cab B, and to see if the auxiliary rack on the second deck of the middle car frame has been extended to the left, in a first phase of moving cab C. The controller will probably pass through FIG. 12 a few times before the auxiliary racks are extended, so that a negative result of either test 89 or 90 will reach other programming through the return point 80. However, when both racks are extended, affirmative results of both tests 89, 90 will reach a pair of steps 91, 92 to set run auxiliary clockwise and counterclockwise signals for the left side of the first deck of the middle elevator and for the right side of the second deck of the top elevator, respectively, so as to continue pulling cabs B and C into the middle and top car frames, respectively. Then a pair of steps 93, 94 reset the auxiliary command signals which were set in steps 84 and 85. A pair of steps 95, 96 set run main signals for the main pinions on the left side of the first deck of the middle elevator and on the right side of the second deck of the top elevator so as to completely pull cab B and cab C onto the middle and top car frames, respectively. Then a step 97 resets the extend flag and a step 98 sets the auxiliary flag.

In a subsequent pass through the subroutine of FIG. 12, test 73 is negative but test 74 is affirmative reaching a test 101 to see if the main rack of cab B has engaged the main pinion on the left side of the first deck of the middle car frame, and a test 102 to determine if the main rack of cab C has engaged the main pinion at the right side of the second deck of the top elevator. These tests may depend upon signals from switches mounted on the other car frame. That is to say, a switch in the second deck of the top cab may provide the signal indicating that the cab has moved far enough for main rack engagement with the first deck of the middle car frame, and a switch in a second deck of the middle car frame may indicate that cab C has moved far enough so that its main rack engages with the main pinion in the second deck of the top car frame. All of this is described more fully in the aforementioned copending U.S. patent application Ser. No. (Attorney Docket No. OT-2320). When both cab B and cab C have moved sufficiently for main rack engagement, affirmative results of tests 101 and 102 reach a step 103, relating to cab B, which resets the auxiliary pinion at the left of the first deck on the middle car frame and a step 104, relating to cab C, which resets the auxiliary pinion at the right side of the second deck of the top car frame. Then a step 105 resets the auxiliary flag and a step 106 sets the main flag to control further passes through FIG.

12, and other programming is then reached in the controller through the return point 80.

In the next subsequent pass through the subroutine of FIG. 12, test 73 is affirmative reaching a test 110 relating to cab B to see if cab B has been moved completely into the first deck of the middle car frame, and a step 111 to see if cab C has been moved completely into the second deck of the top car frame. In the first few passes through the subroutine of FIG. 12 after the main flag is set, the cabs will not have completed their journeys onto the respective car frames, so that negative results of test 110 and or test 111 will cause other programming to be reached through the return point 80. Eventually, both cabs will be in place so affirmative results of tests 110 and 111 will reach a pair of steps 112, 113 to reset the run signals for the main pinions. A pair of steps 114, 115 set the direction for the bottom car to up (which is the direction of travel for the bottom car in cycle three, FIG. 3) and set the target floor for the bottom car to the second level, lower floor. Then a step 116 sets direction for the middle car frame to be down, which is the way it will move during cycle three. A pair of steps 117, 118 set the direction for the top elevator to up, which is the direction it will move in cycle three and set its target floor equal to the low floor at the sky level, as seen in FIG. 3. Then, a step 119 will reset the main flag, a step 120 will reset the cycle two flag, a step 121 will reset the transfer flag, and a step 122 will set the run flag, which controls further programming in FIG. 10.

In FIG. 10, in a next subsequent pass through the run routine, since the transfer flag is reset, a negative result of test 45 reaches test 46 which is now affirmative, reaching a step 126 which sets the cab/car locks in all of the decks of all of the car frames. This will firmly lock each of the cabs A, B, C to the corresponding deck, redundantly for cab A which was not unlocked in cycle two, and having no effect in the empty decks of the car frames. Then a test 127 determines if the cab/car locks in all of the car frames are locked, or not. This is accomplished by signals from position detectors such as switches, as described in the related copending application. A test 128 determines if the doors are fully closed on all of the cabs. If either of these tests are negative, other programming is reached through the return point 50. But when all the doors are closed (particularly the doors of cab A) and all the cabs are locked in place (particularly cabs B and C) affirmative results of test 127 and 128 reach a pretorque and unlock subroutine 129 which operates all of the elevator motors sufficiently to take all stress off the car/floor locks so that those locks may be retracted, as is described in a commonly owned, copending U.S. patent application Ser. No. (Attorney Docket No. OT-2285) filed on Nov. 29, 1995. During the pretorquing and unlocking, points in the subroutine 129 may be reached where other programming is reverted to through the return point 50. When the process is complete, the routine of FIG. 10 advances to a test 130 which determines if all of the car floor locks are unlocked. If not, other programming is reached through the return point 50. When the locks are all unlocked, a step 131 sets the run command for all of the elevators, causing them to move in the hoistway in response to motion controllers of the type known in the art (not shown). And then a step 132 resets the run flag, and other programming is reverted to through the return point 50.

In the next subsequent pass through the routine of FIG. 10, tests 45 and 46 are negative reaching the tests 47–49 to see if any of the cars are still running. Throughout the time that the cars are traversing their respective hoistways, all of tests 47–49 will be affirmative, thereby reaching the return point 50. At the end of cycle three, these three tests will be negative, causing the transfer flag to be once again set in the step 53. In the transfer routine of FIG. 11, at the end of cycle three, test 64 will be affirmative causing the cycle four flag to be set which causes a cycle four subroutine to be reached through a transfer point 133. The cycle four subroutine (as well as the cycle six subroutine and the cycle eight subroutine) are the same as that illustrated in FIG. 12, except that all of the tests and steps relate to moving the cabs between different pairs of decks, in an obvious fashion in view of FIGS. 1–8, and therefore are not described further.

By reference to FIGS. 1–8, it can be seen that the invention, employing an extra deck in the non-terminal hoistway (the middle hoistway herein), allows the upwardly traveling car to use the center deck of the middle car frame in each case, while the downwardly traveling car will use the lowermost deck of the middle car frame (cab B, FIGS. 1 and 2) in alternate runs, and will use the uppermost deck of the middle car frame (cabs C, FIGS. 5 and 6) in runs intermediate said alternate runs. However, by starting the cars out in FIG. 1 on different decks, the center deck of the middle car frame can be used for downwardly traveling cabs while the upper and lower decks of the middle car frame are alternatively used for upwardly traveling cabs.

The present invention not only works with three hoistways, as seen in the embodiment of FIGS. 1–12, but works in a similar fashion for any number of hoistways, provided only that all of the center hoistways (other than the uppermost and lowermost hoistway) have an extra deck elevator car frame therein. This is illustrated in FIGS. 13–20. The controls therefore are obvious in view of the description of FIGS. 1–8 hereinbefore.

The invention may also be used for transporting more than one cab in each hoistway at the same time, as is illustrated in FIGS. 21–27. Therein, three hoistways are shown, and the middle hoistway has a five-deck car frame therein. The other hoistways have four-deck car frames therein. That is, the invention works when the highest and lowest hoistways have two decks per elevator car and the other hoistways have one more than two decks per elevator car. In the embodiment of FIGS. 21–27, the cabs cannot be in adjacent decks on the car frames, and for that reason, the landings must be separated by a full deck.

Figure 36:
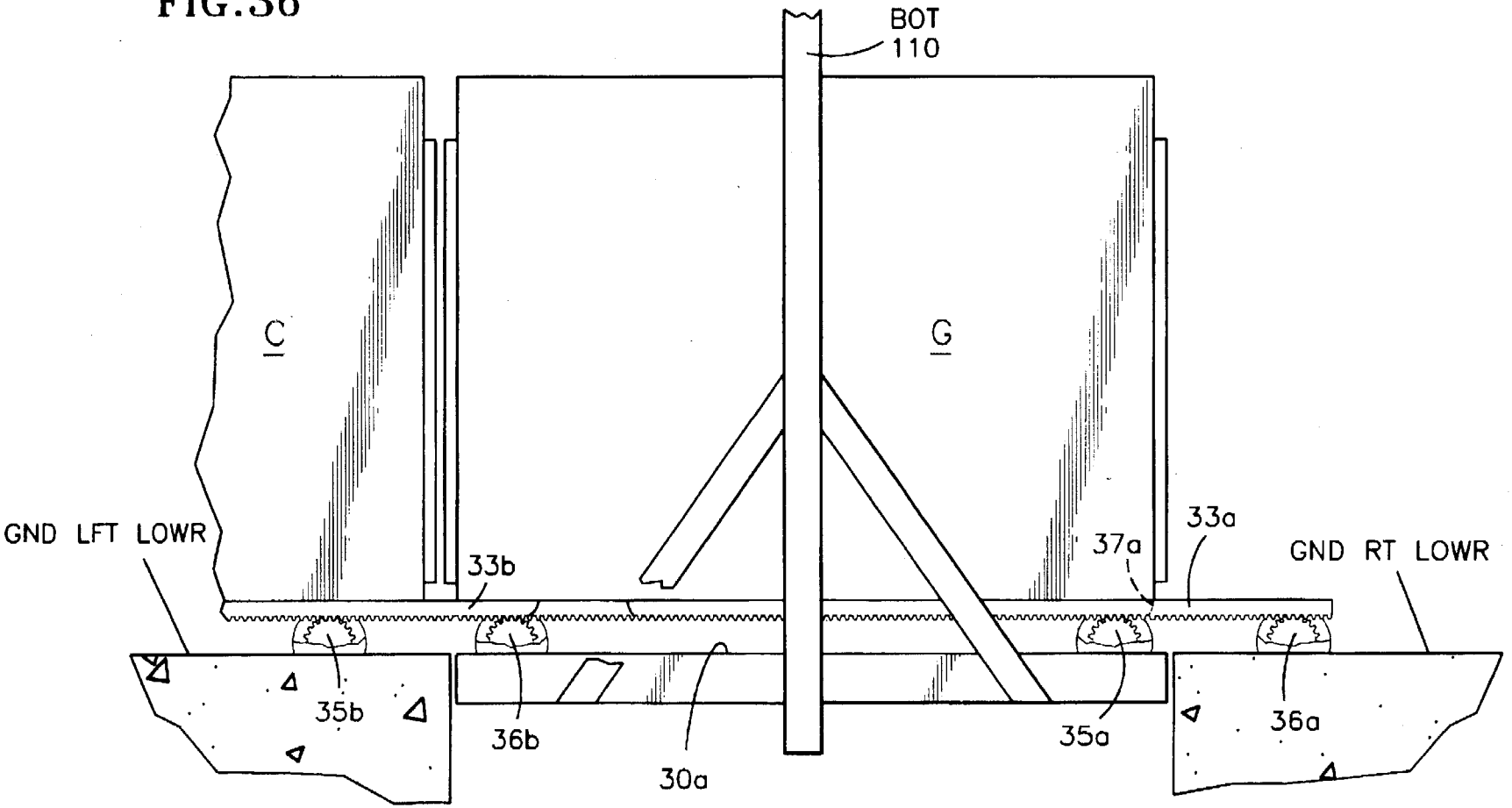
FIG. 36 is a simplified, side elevation view of an elevator car frame and a cab between two landings to and from which the cab may be transferred.

The invention may also be used in a system in which the loading and unloading of passengers occurs while the cabs are on landings, out of the hoistway, as is illustrated in FIGS. 28–35. The embodiments of FIGS. 28–35 is the same as that of FIGS. 21–27 except that there are four more cabs which are in off-hoistway landings for loading and unloading as the other cars are traveling in the hoistway and exchanging car frames. The transfer of cabs from car frame to landing and from landing to car frame may be as described in a commonly owned copending U.S. patent application Ser. No. (Attorney Docket No. OT-2297), filed on Nov. 29, 1995. To accommodate such transfers, it is necessary that the landings be provided with motorized pinions as illustrated in FIG. 36, with respect to cab C and cab G in FIG. 32. Therein, the apparatus is similar to that described with respect to FIG. 9 except that the bottom car frame 110 (as well as the top car frame 111, FIG. 28) requires auxiliary pinions **35*a*, 36*b* on both the right and left sides of each deck, along with main pinions (not shown) on both sides of each deck. And each landing also requires a main pinion along with auxiliary pinions 35*b*, 36*a*. Notice that the auxiliary rack 33*b* of the cab C in FIG. 36 has been extended into contact with the auxiliary pinion 36*b* on car frame 30*a* at the same time as the auxiliary rack 33*a* of cab G has been extended into contact with auxiliary pinion 36*a*** on the ground right lower landing.

Figures 28, 29, 30, 31, 32, 33, 34, 35:
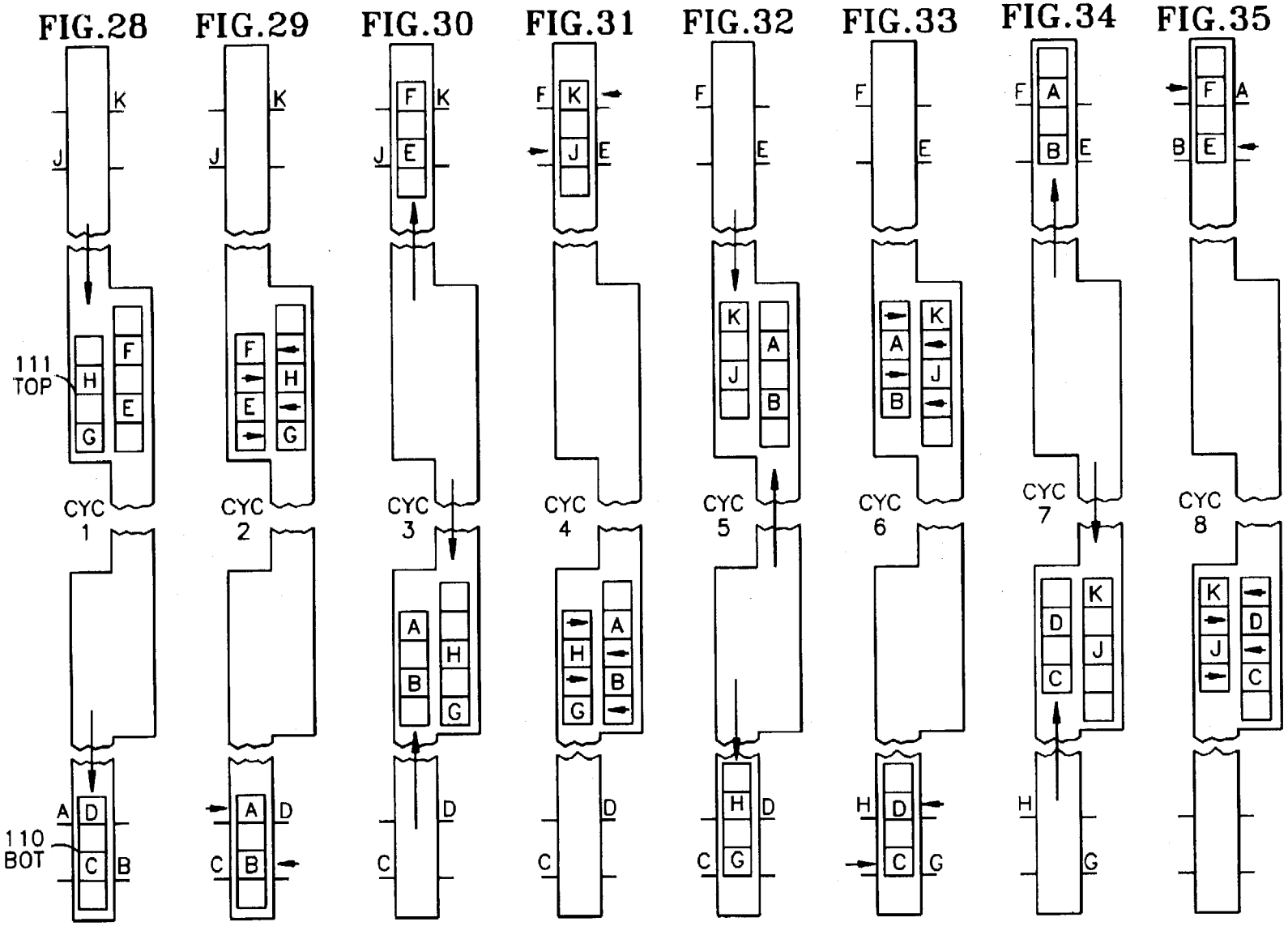
FIGS. 28–35 are simplified, stylized, side elevation views of eight successive cycles of operation of a three-hoistway, two cabs-per-hoistway shuttle in which passenger loading and unloading is done off-hoistway.

In the embodiment of FIGS. 28–35, at the time when cabs are transferred between the top car frame and the middle car frame, cabs are also transferred between the bottom car frame and the ground level landings, in cycles two (FIG. 29) and six (FIG. 33). At the times when cabs are being transferred between the bottom car frame and the middle car frame, cabs are also being transferred between the top car frame and the sky level landings, as in cycle four (FIG. 31) and cycle eight (FIG. 35). During the time that some cabs are moving in the hoistways, the cabs at the landings have their doors open to allow passengers to exit the cabs and other passengers to enter the cabs.

Figure 37:
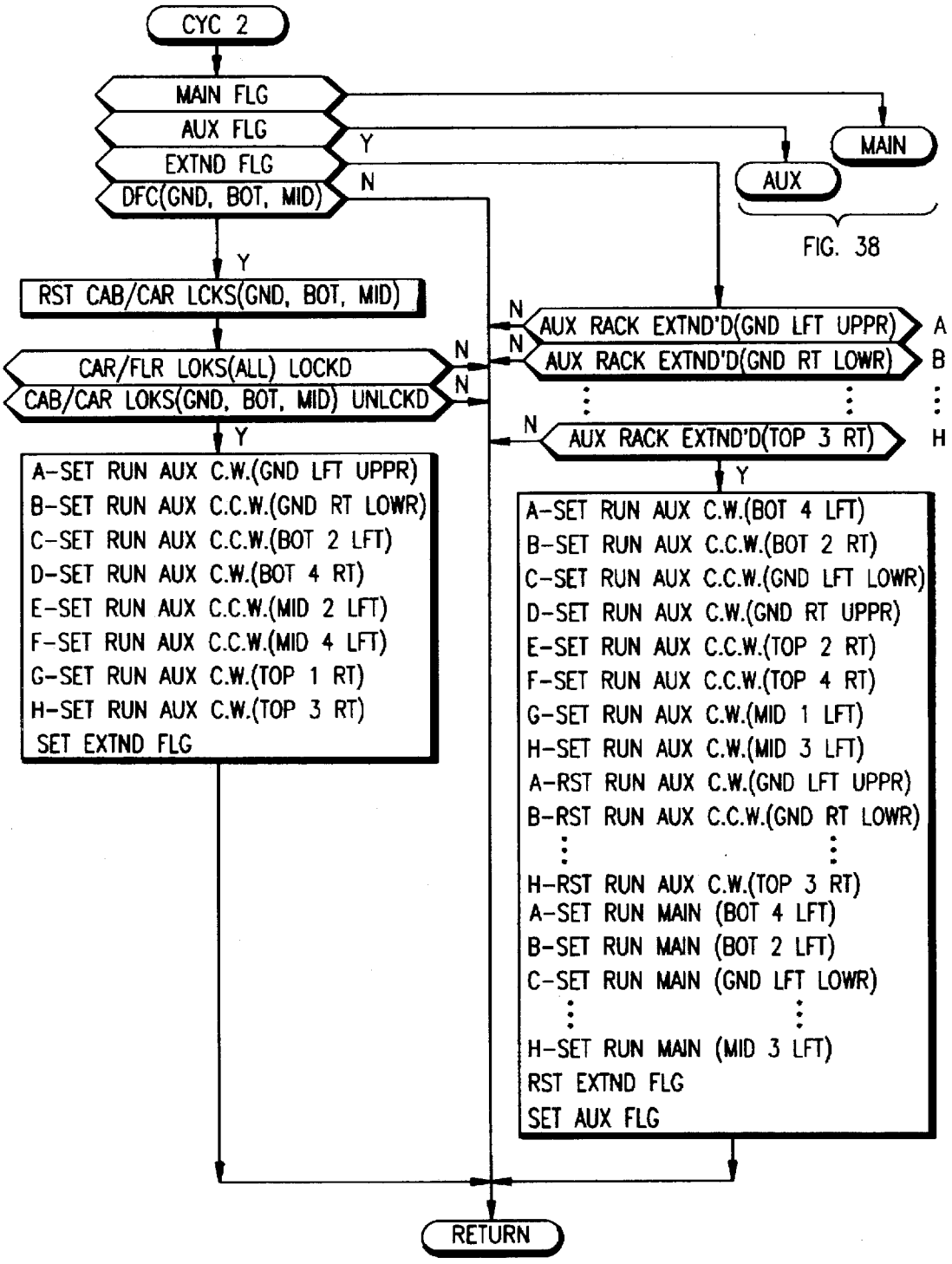
FIGS. 37 and 38 are a logic flow diagram of a "cycle 2" subroutine which may be used within the transfer routine of FIG. 11, in a controller working with the embodiment of the invention shown in FIGS. 28–35.
Figure 38:
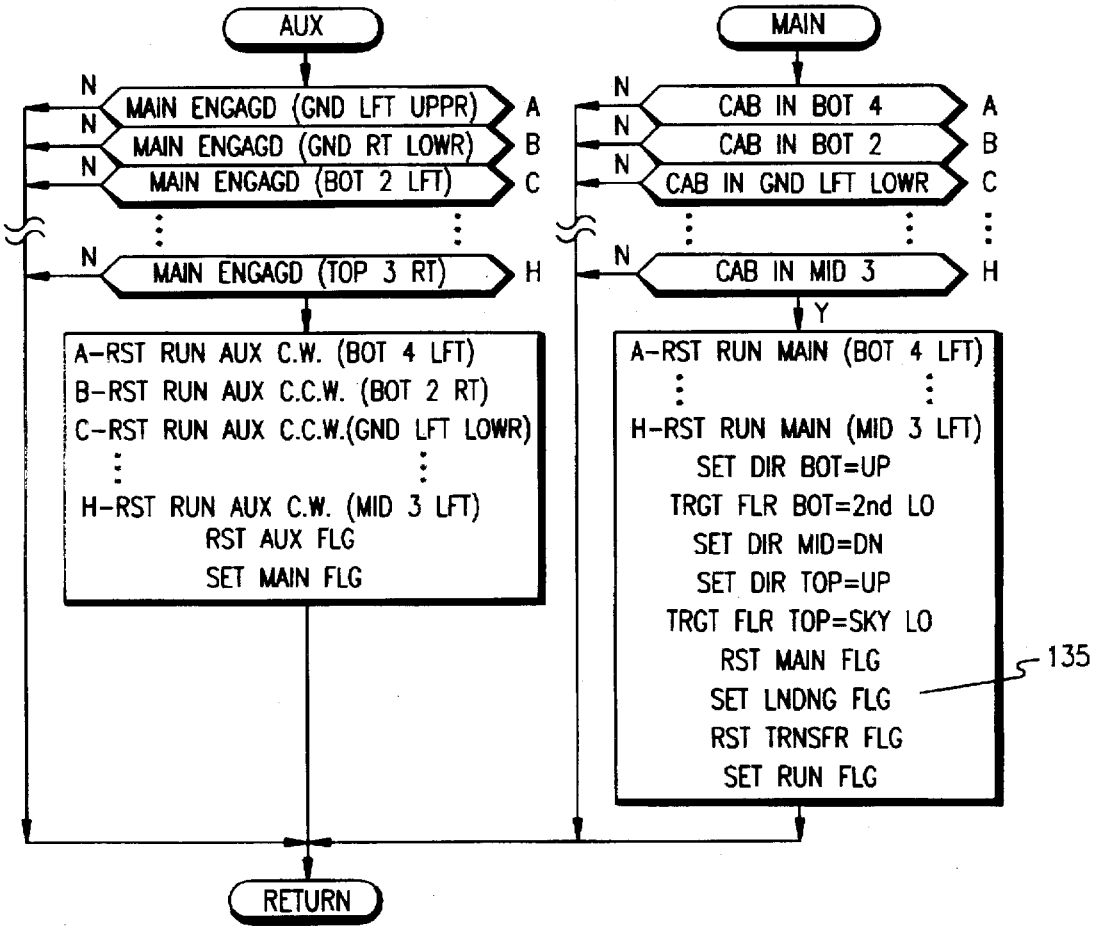

A controller for the embodiment of FIGS. 28–35 may utilize the run routine of FIG. 10 and the transfer routine of FIG. 11. However, the cycle subroutines, while similar to that shown for cycle two in FIG. 12, are more complex to accommodate moving cabs to and from landings. The cycle two subroutine for the embodiment of FIGS. 28–35 includes transferring cabs between car frames and landings, and transferring two cabs at a time between car frames. Nonetheless, the cycle two subroutine of FIGS. 37 and 38 comprises only the logical extension of that shown in FIG. 12, and is not described further herein, with the exception of one functional difference. When the cabs have been fully transferred, the cycle two flag is not reset until it is assured that the door opening procedure for any cabs at the landings has occurred. Therefore, at the end of the cycle two transfer subroutine as illustrated in FIG. 38, a landing flag is set in a step 135 in place of resetting the cycle two flag in step 120 of FIG. 12. As soon as all the cabs have been transferred, the run flag is set in preparation for the next run of the cars, as described hereinbefore. At that time, a landing flag is set in the step 135 (FIG. 38).

Figure 39:
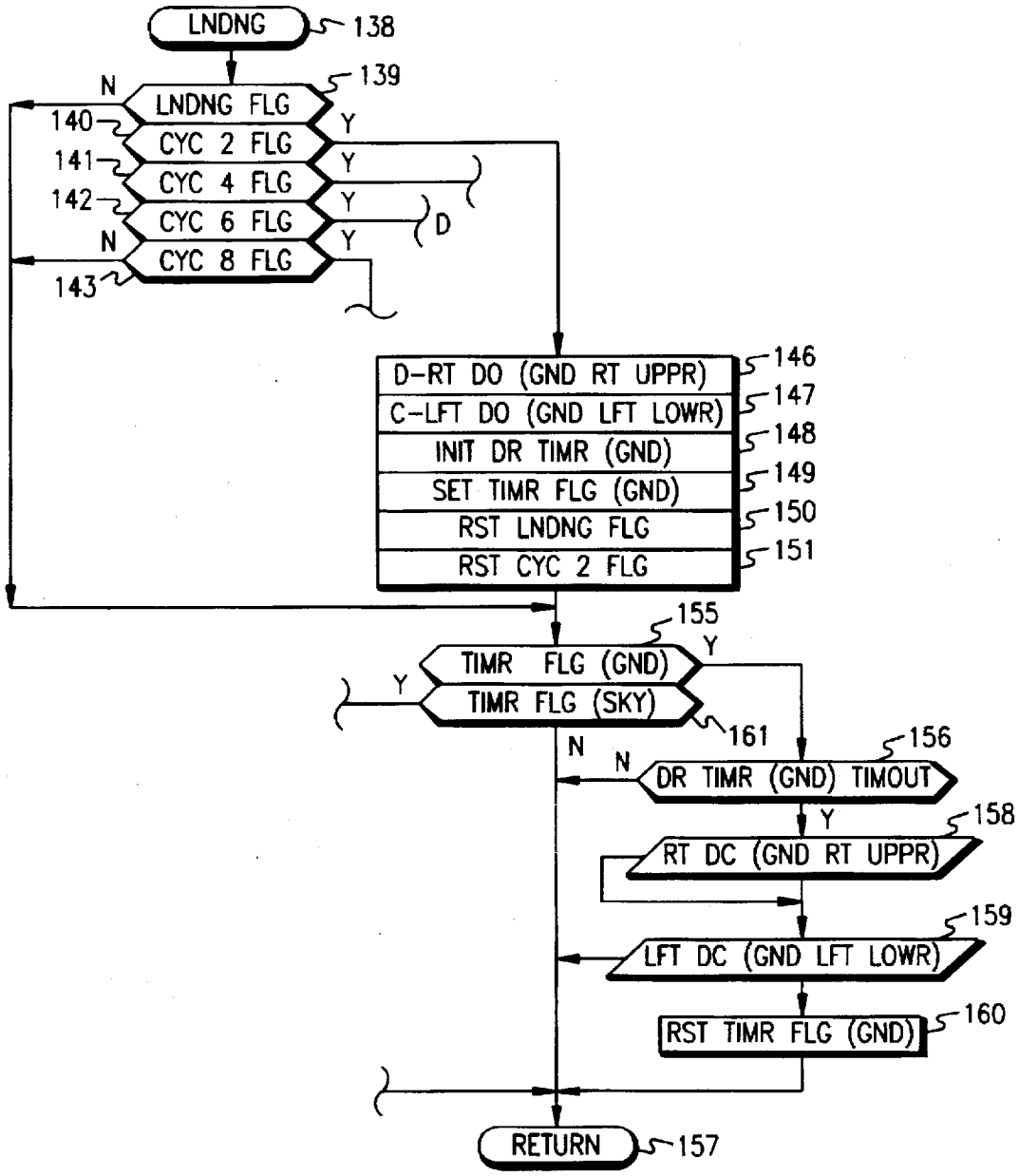
FIG. 39 is a logic flow diagram of a "landing" routine for use in a controller working with the embodiment of the invention in FIGS. 28–35.

In FIG. 39, a landing routine is reached periodically in the normal course of executing routines in the controller. The routine is reached through an entry point 138 and a first step 139 determines if the landing flag is set or not. If it is not, the upper half of the routine of FIG. 39 is bypassed. But once the landing flag is set, then a series of steps 140–143 determine which of the cycle flags has been set. Assuming the cycle two flag has been set, an affirmative result of test 140 will reach a step 146 relating to cab D in FIGS. 29 and 30, to provide a right door open command to any cab in the right upper landing at the ground level. Then a step 147, relating to cab C in FIGS. 29 and 30, provides a left door open command to whichever car is in the left lower ground level landing. A step 148 then initiates a door timer for cycle two. In this embodiment, separate timers are required since the opening of the doors at the ground landings (at the beginning of cycle 3) overlap with the open time of the doors at the sky landings (which close near the end of cycle 3). Once this timer is initiated, a step 149 sets a timer flag for the ground timer, a step 150 resets the landing flag, and a step 151 resets the cycle two flag. In the next subsequent pass through the routine of FIG. 39, test 139 will be negative bypassing all of the tests and steps 140–151 and reaching a test 155 to determine if the timer flag for the ground landings has been set. Since it was set in step 149, an affirmative result of test 155 reaches a test 156 to see if the ground door timer has timed out or not. Initially it will not have, so a negative result of test 156 causes other programming to be reached through a return point 157. In subsequent passes through the routine of FIG. 39, test 139 is negative, test 155 is affirmative and test 156 is negative until such time as the timer times out. Then an affirmative result of test 156 reaches a pair of subroutines 158, 159 which cause doors of the cab standing in the lower level landings to be closed (such as the doors of cabs C and D in FIGS. 30–32). The door timers are set to time out in a time frame which is just less than the amount of time it takes for the elevators to make a round trip run in their corresponding hoistways. And then a step 160 resets the ground timer flag. In subsequent passes through the routine of FIG. 39, tests 139, 155 and a test 161 are all negative bypassing all of the functions of the landing routine, and causing other programming to be reached through the return point 157. The portions of the routine of FIG. 39 which would be reached by affirmative results of tests 121–123 and 141 (not shown) are similar to the functions described hereinbefore and are not described further. The ground timer will be used for cycle six, and a sky timer will be used for cycles four and eight.

In FIGS. 28–35, the two cabs (J, K) at the sky level could be on the same side (right or left) of the hoistway, as could the two cabs (A, B) at the ground level; the sky and ground cabs could be on the same or opposite sides. The sky and ground car frames may come to reset at the same floor each time, thereby exchanging passengers at two lobbies each, one above the other, in alternative runs. None of this matters to the invention.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator shuttle system for a building having a plurality of levels, comprising:

at least three overlapping elevator hoistways, each having a multi-deck elevator car frame movable from a low end of the corresponding hoistway to a high end of the corresponding hoistway, the low end of each hoistway except the lowest of said hoistways in said system being at the same intermediate building level as and adjacent to the high end of another of said hoistways, the high end of each hoistway except the highest of said hoistways in said system being at the same intermediate building level as and adjacent to the low end of another one of said hoistways;

a plurality of elevator cabs, there being a number, N, of said cabs for each of said car frames, said cabs being movable horizontally between said car frames;

a pair of said car frames, one movable in said lowest of said hoistways and one movable in said highest of said hoistways, each having twice as many decks as said number, N, of cabs per car frame; each other car frame in said system except said pair of car frames having 2N plus one decks;

a car motion means for each of said car frames, each for moving the corresponding car frame in successive runs in either of two directions along the corresponding hoistway, said car frames each being moved to align the decks of said pair of car frames with the lowest 2N decks of a related car frame in the corresponding adjacent hoistway at the end of each alternate run of a given direction and being moved to align the decks of a first and a second car frames of said pair of car frames with the highest 2N decks of said related car frame at the end of each run in said given direction intermediate said alternate runs; and means for transferring one of said cabs from one deck of one of said car frames to a deck of an adjacent car frame aligned with said one deck and for transferring another of said cabs from another deck of said adjacent car frame to a deck of said one car frame aligned with said another deck.

2. An elevator shuttle system according to claim 1 wherein:

said number, N, is one, said pair of car frames each have two decks, and said each other car frame in said system has three decks; and said car motion means moves said car frames in said hoistways in a manner to align all cabs traveling in one of said two directions on one of said pair of car frames with a center deck of a three-deck car frame.

3. An elevator system according to claim 2 wherein:

said car motion means moves said car frames in said hoistways in a manner to also align cabs on a three-deck car frame and traveling in the other of said two directions with an empty deck of said one of said pair of car frames.

4. An elevator shuttle system according to claim 1 wherein:

said number, N, is two, said pair of car frames each have four decks, and said each other car frame in said system has five decks; and said car motion means moves said car frames in said hoistways in a manner to align cabs traveling in one of said two directions on one of said pair of car frames with the second and fourth decks of a five-deck car frame.

5. An elevator system according to claim 4 wherein:

said car motion means moves said car frames in said hoistways in a manner to also align a pair of cabs on a five-deck car frame and traveling in the other of said two directions with a pair of empty decks of said one of said pair of car frames.

6. An elevator system according to claim 1 wherein:

said shuttle system has three hoistways and one car frame having 2N plus one decks.

7. An elevator system according to claim 6 wherein N=1 and said pair of car frames have two decks each.

8. An elevator system according to claim 6 wherein N=2 and said pair of car frames have four decks each.

9. An elevator system according to claim 1 wherein:

said shuttle system has four hoistways and two car frames having 2N plus one decks.

10. An elevator system according to claim 9 wherein N=1 and wherein two car frames have two decks each and two car frames have three decks each.

11. A method of simultaneously moving a plurality of elevator cabs in an up direction and in a down direction in a building having at least three overlapping elevator hoistways, the low end of each hoistway except the lowest of said hoistways in said system being at the same intermediate building level as and adjacent to the high end of another of said hoistways, the high end of each hoistway except the highest of said hoistways in said system being at the same intermediate building level as and adjacent to the low end of another one of said hoistways, comprising:

a) providing, for each hoistway, a multi-deck elevator car frame movable from a low end of the corresponding hoistway to a high end of the corresponding hoistway;

b) providing N elevator cabs for each of said car frames, said cabs being transferable horizontally between said car frames; and c) horizontally transferring successive cabs that are moving in a first one of said directions from one of said car frames into a given deck of another of said car frames while simultaneously horizontally transferring successive cabs that are moving in the second one of said directions from a deck of said another car frame above said given deck onto a deck of said one car frame during alternate runs of said car frames, from a deck of said another car frame below said given deck onto a deck of said one car frame during runs of said car frames intermediate said alternate runs.

12. A method according to claim 11 wherein said step a) comprises:

d) providing a car frame for said lowest hoistway and a car frame for said highest hoistway which have twice as many decks as said number, N, of elevator cabs per car frame, and providing for each other hoistway a car frame which has 2N plus one decks.

13. A method according to claim 12 wherein said step b) comprises:

e) providing one cab per hoistway, said step a) comprises:

f) providing a triple-deck car frame for said each other hoistway; and said step c) comprises:

g) transferring cabs moving in said first direction into the middle deck of said another of said car frames.

14. A method according to claim 13 wherein said building has three of said hoistways, and said step d) comprises:

h) providing two double car frames and one triple deck car frame.

15. A method according to claim 13 wherein said building has four of said hoistways and said step d) comprises:

i) providing two double deck car frames and two triple deck car frames.

16. A method according to claim 12 wherein said step b) comprises:

e) providing two cabs per hoistway and step a) comprises:

f) providing a five-deck car frame for said each other hoistway; and said step c) comprises:

g) transferring cabs moving in said first direction into the second and fourth of said another of said car frames.

17. A method according to claim 16 wherein said building has three of said hoistways, and said step d) comprises:

k) providing two four-deck car frames and one five-deck car frame.

18. A method according to claim 16 wherein said building has four of said hoistways and said step d) comprises:

l) providing two four-deck car frames and two five-deck car frames.

19. A method according to claim 11 wherein said step c) comprises:

m) horizontally transferring, at the end of each run of said each other car frame in said system, a cab from said each other car frame to one of said pair of car frames and a cab from one of said pair of car frames to said each other car frame.

20. A method of simultaneously moving a plurality of elevator cabs in an up direction and in a down direction in a building having between three and four overlapping elevator hoistways, the low end of each hoistway except the lowest of said hoistways in said system being at the same intermediate building level as and adjacent to the high end of another of said hoistways, the high end of each hoistway except the highest of said hoistways in said system being at the same intermediate building level as and adjacent to the low end of another one of said hoistways, comprising:

a) providing, for each hoistway, a multi-deck elevator car frame movable from a low end of the corresponding hoistway to a high end of the corresponding hoistway, a pair of said car frames, including the car frame in the highest of said hoistways and the car frame in the lowest of said hoistways, having at least two decks and the other car frames heaving at least three decks;

b) providing at least one elevator cab for each of said car frames, said cabs being transferable horizontally between said car frames; and c) horizontally transferring, at an end of each run of said each other car frame in said system, a cab from said each other car frame to one of said pair of car frames and a cab from one of said pair of car frames to said each other car frame.

21. A method according to claim 20 wherein said step b) comprises:

d) providing one cab per car frame, said step a) comprises:

d) providing a triple-deck car frame for said each other hoistway; and said step c) comprises:

f) transferring cabs moving in a first direction into the middle deck of said another of said car frames.

22. A method according to claim 20 wherein said step b) comprises:

d) providing two cabs per car frame; said step a) comprises:

e) providing a five-deck car frame for said each other hoistway; and said step c) comprises:

f) transferring cabs moving in a first direction into the second and fourth of said another of said car frames.

* * * * *

UNITED STATES PATENT AND TRADEMARK OFFICE

CERTIFICATE OF CORRECTION

PATENT NO. : 5,749,441

DATED : May 12, 1998

INVENTOR(S) : Joseph Bittar, et al.

Figure 12B:
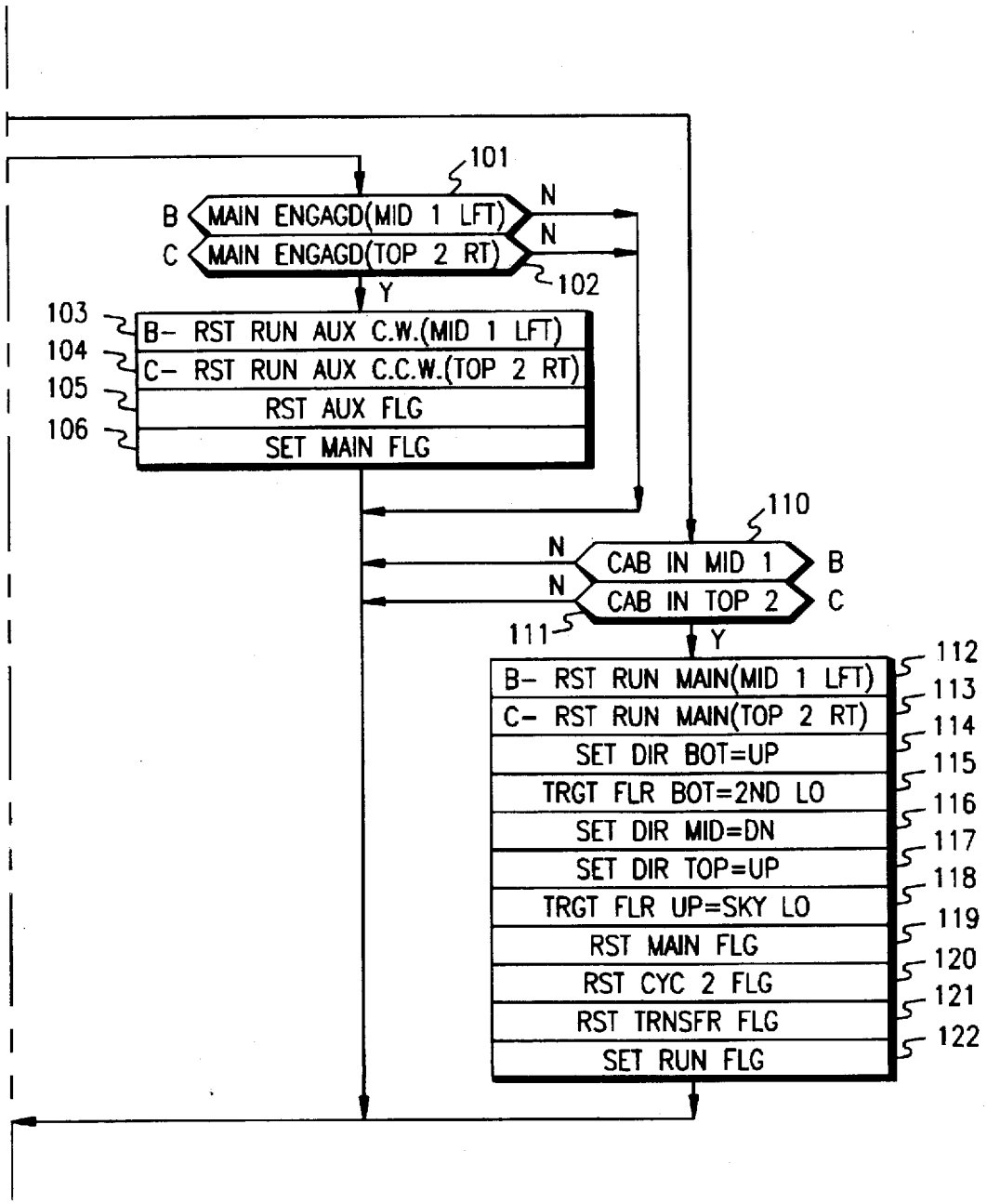
FIG. 12 is a logic flow diagram of a "cycle" subroutine employed in the transfer routine of FIG. 11.
Figures 13, 14, 15, 16, 17, 18, 19, 20:
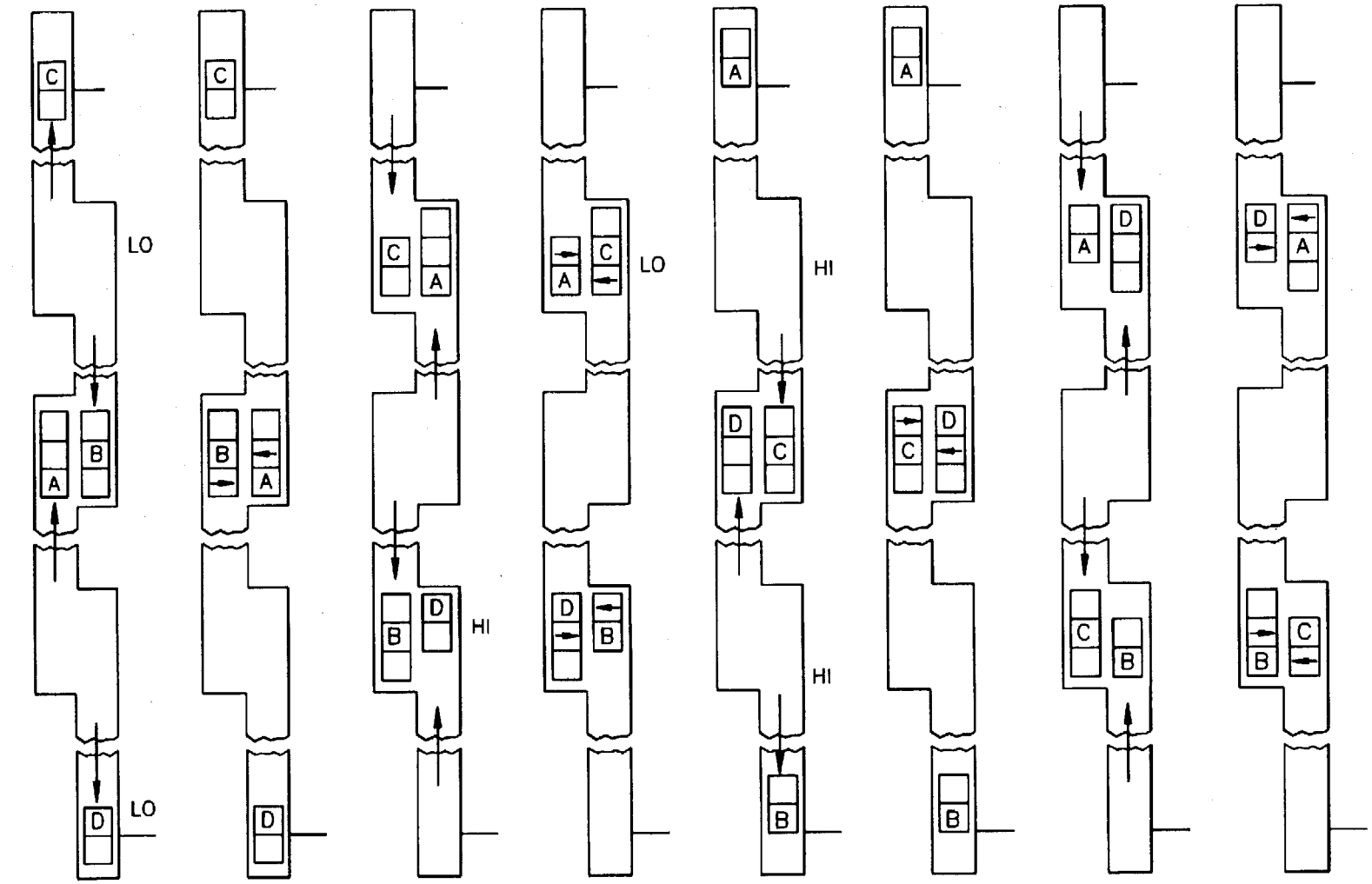
FIGS. 13–20 are simplified, stylized, side elevation views of eight successive cycles of operation of a four-hoistway, extra deck elevator shuttle according to the invention.
Figures 21, 22, 23, 24, 25, 26, 27:
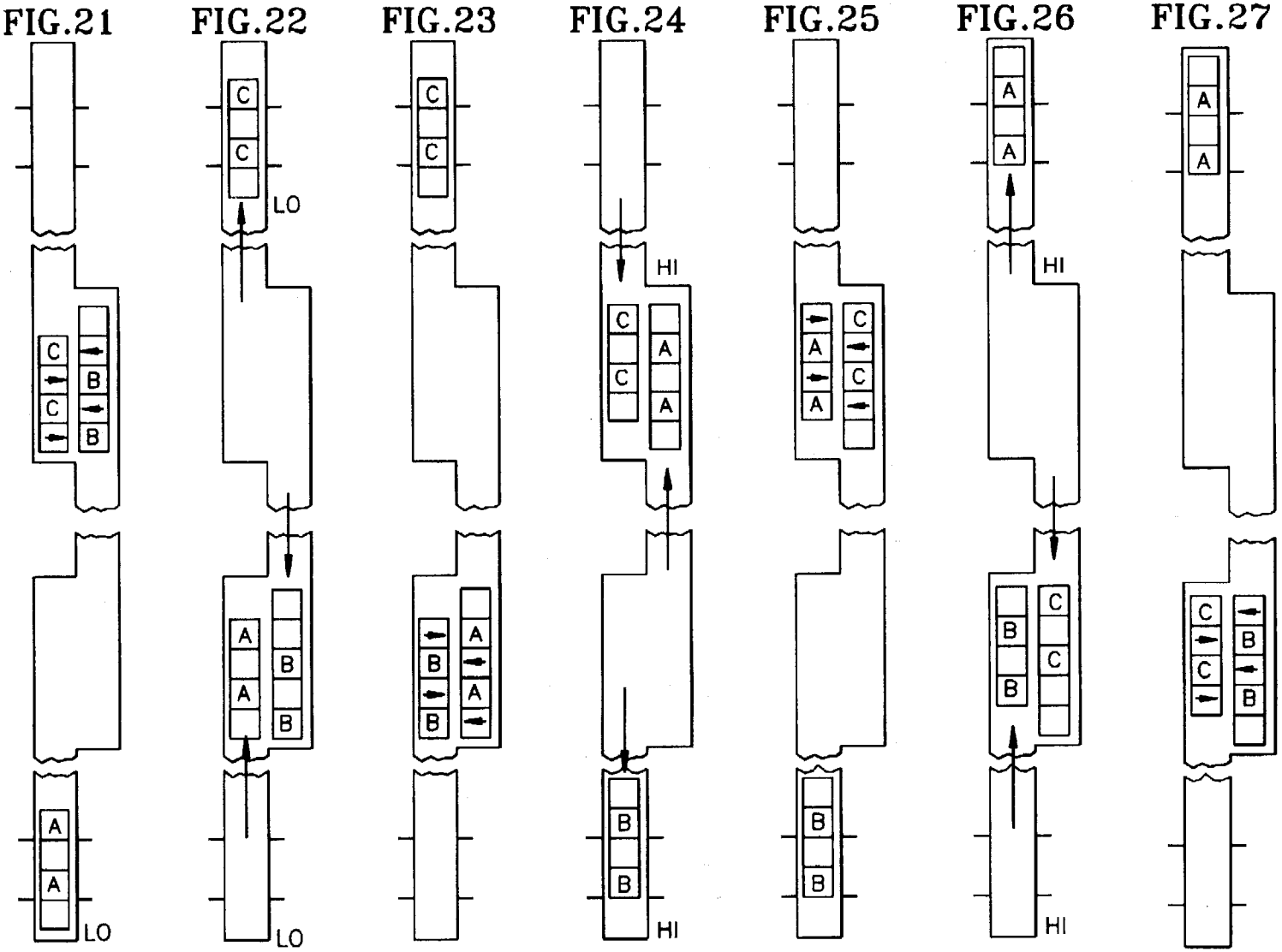
FIGS. 21–27 are simplified, stylized, side elevation views of seven successive cycles of a three-hoistway elevator system in which two cabs are moving in each hoistway at all times.

It is certified that error appears in the above-identified patent and that said Letters Patent is hereby corrected as shown below:

Column 2, line 24, change "Fig. 12 is" to -- Figs. 12, 12A and 12B are--.

Signed and Sealed this

Sixteenth Day of February, 1999

*Attest:*

*Attesting Officer*

*Acting Commissioner of Patents and Trademarks*